US006860116B2

(12) United States Patent
Lifson et al.

(10) Patent No.: US 6,860,116 B2
(45) Date of Patent: Mar. 1, 2005

(54) PERFORMANCE ENHANCEMENT OF VAPOR COMPRESSION SYSTEMS WITH MULTIPLE CIRCUITS

(75) Inventors: Alexander Lifson, Manlius, NY (US); Michael F. Taras, Fayetteville, NY (US); Howard H. Fraser, Jr., Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 188 days.

(21) Appl. No.: 10/247,442

(22) Filed: Sep. 18, 2002

(65) Prior Publication Data

US 2004/0050093 A1 Mar. 18, 2004

(51) Int. Cl.[7] ..... F25B 5/00; F25B 1/00; F25B 1/10

(52) U.S. Cl. ..... 62/498; 62/510; 62/117

(58) Field of Search ..... 62/498, 510, 228.5, 62/117, 332, 333, 335

(56) References Cited

U.S. PATENT DOCUMENTS 4,149,389 A * 4/1979 Hayes et al. ..... 62/79

* cited by examiner

*Primary Examiner*—Chen Wen Jiang
(74) *Attorney, Agent, or Firm*—Bachman & LaPointe, P.C.

(57) ABSTRACT

A vapor compression system includes a first circuit having first components including a first compressor, a first condenser and a first evaporator; a second circuit having second components including a second compressor, a second condenser and a second evaporator; and interconnecting flow lines for selectively communicating the first compressor with at least one component of the second components to boost system performance at part-load operation as well as enhance its reliability and improve unloading capability.

19 Claims, 3 Drawing Sheets

PERFORMANCE ENHANCEMENT OF VAPOR COMPRESSION SYSTEMS WITH MULTIPLE CIRCUITS

BACKGROUND OF THE INVENTION

The invention relates to vapor compression systems and, more particularly, to performance enhancement of vapor compression systems which have multiple circuits.

Vapor compression systems are used in commercial and other refrigeration and air-conditioning systems and may typically include packaged equipment such as rooftop systems and small chillers.

Such systems utilize vapor compression cycles and may typically include more than one compressor bank (screw, scroll, reciprocating and the like), each integrated into a separate circuit.

In such systems, it is always a desirable objective to improve efficiency, unloading capability and reliability It is therefore the primary object of the present invention to provide a vapor compression system and method for operating same wherein system efficiency and unloading capability are improved.

It is a further object of the present invention to provide such a system and method wherein reliability is also improved.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a first circuit comprising first components including a first compressor, a first condenser and a first evaporator; a second circuit comprising second components including a second compressor, a second condenser and a second evaporator; and means for selectively communicating said first compressor with at least one component of said second components.

In further accordance with the present invention, a method for operating a vapor compression system including at least a first circuit comprising first components including a first compressor, a first condenser and a first evaporator and a second circuit comprising second components including a second compressor, a second condenser and a second evaporator is provided which method comprises, selectively communicating said first compressor with at least one component of said second components whereby said at least one component can be utilized while said second compressor is shut down.

BRIEF DESCRIPTION OF THE DRAWINGS

A detailed description of preferred embodiments of the present invention follows, with reference to the attached drawings, wherein.

DETAILED DESCRIPTION

The invention relates to vapor compression systems and, more particularly, to a multiple circuit vapor compression system and method for operating same wherein components such as the condenser and/or evaporator of one circuit can be selectively incorporated into the other circuit.

In multi-circuit systems, it is frequently necessary or desirable to shut down one or the other compressors of the system. This may be desirable under partial load conditions or necessary for maintenance or repair purposes, and the like. During such shut down, the components of the shut down circuit typically are idle, resulting in loss of potential part-load performance (capacity and efficiency). In accordance with the present invention, a system and method are provided whereby the components of the shut down circuit can be selectively connected with an active circuit, thus reducing the burden on the components in the active circuit and improving part-load performance (capacity and efficiency) and enhancing unloading capability of the vapor compression system.

Figure 1:
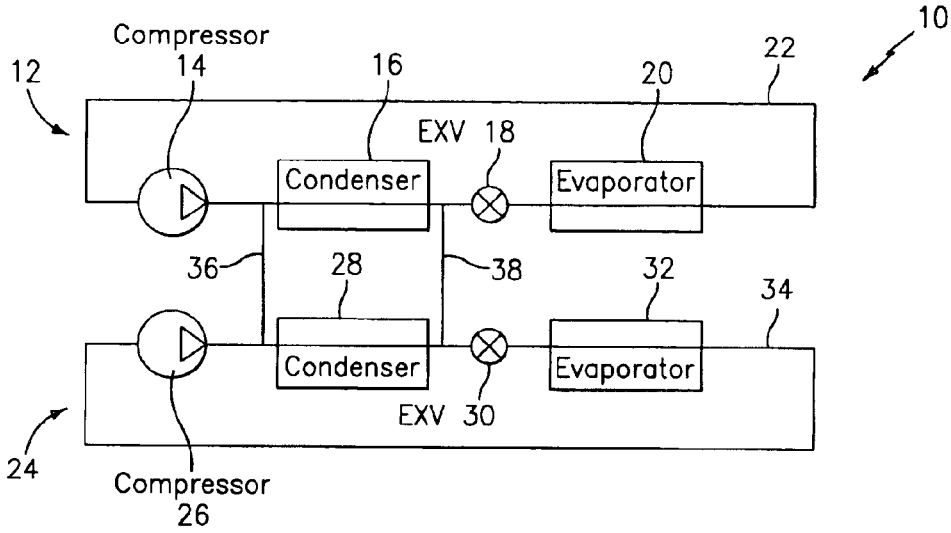
FIG. 1 illustrates a multi-circuit embodiment in accordance with the present invention.

Referring now to the drawings, FIG. 1 illustrates a vapor compression system 10 in accordance with the present invention. System 10 includes a first circuit 12 including a compressor 14, a condenser 16, an expansion device 18 and an evaporator 20. As shown, these components are connected with flow lines 22 whereby refrigerant is conveyed from component to component in a manner which is well known to a person of ordinary skill in the art. FIG. 1 further illustrates a second circuit 24 which includes a second compressor 26, a second condenser 28, a second expansion device 30 and a second evaporator 32, all of which are connected by flow lines 34, also in a manner which is well known to a person of ordinary skill in the art.

In accordance with the present invention, interconnecting flow lines 36, 38 are provided between first circuit 12 and second circuit 24 and advantageously allow for incorporation of a component such as second condenser 28 into first circuit 12, for example when second compressor 26 is shut down when capacity demand is low, or for maintenance, repair or the like. This advantageously incorporates the function of condenser 28 into circuit 12, thereby improving efficiency of circuit 12.

In accordance with this embodiment of the present invention, during normal operation, first compressor 14 and second compressor 26 are both operated under substantially the same conditions, and flow through lines 36, 38 would be negligible. However, should either first compressor 14 or second compressor 26 require shut down under low load conditions or for maintenance or repair or some other reason, interconnecting flow lines 36, 38 advantageously can selectively communicate the other compressor, which is still in operation, with the condenser 16, 28 of the circuit whose compressor has been shut down.

It should also be appreciated that although FIG. 1 shows a system having two circuits, the present invention is beneficial to any multiple circuit system, including those having three or more circuits as well.

In this embodiment, additional interconnecting lines would be positioned between respective additional circuits such that the compressor of one or more circuits could selectively be communicated with components of additional circuits. These multiple circuit embodiments are not illustrated for the sake of simplicity, but would include the various components as illustrated in FIG. 1 above.

Figure 2:
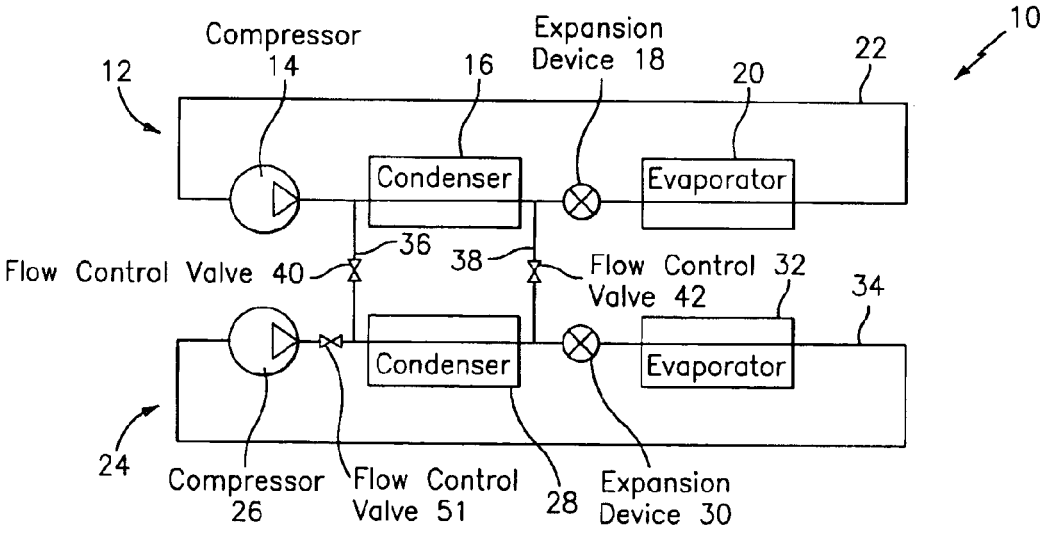
FIG. 2 illustrates a vapor compression system in accordance with the present invention utilizing flow control valves in the interconnecting flow lines for selectively connecting the condenser from circuit 2.

FIG. 2 illustrates a further embodiment in accordance with the present invention, and includes similar components bearing similar reference numerals to those set forth in connection with FIG. 1 above. In this embodiment, however, flow control valves 40, 42 are incorporated into flow lines 36, 38 respectively, and can be further used in accordance with the present invention to selectively communicate condenser 28 into first circuit 12, or condenser 16 into second circuit 24, as desired. In further accordance with the embodiment illustrated in FIG. 2, a valve or control valve 51 can be positioned between second compressor 26 and interconnecting flow line 36 such that back-flow into second compressor 26 can be prevented in case the expansion device in that circuit is not a hard shutdown device. Although not shown for simplicity, such a valve can likewise be incorporated into first circuit 12 as well.

It should be appreciated that in the embodiments of FIGS. 1 and 2, interconnecting flow lines 36, 38 are positioned upstream and downstream, respectively, of condensers 16, 28. Thus, during operation, interconnecting flow line 36 will carry a portion of flow from one circuit to the other circuit for inlet to the other condenser, while interconnecting flow line 38 will carry discharge from that condenser back to complete the operational circuit.

Figure 3:
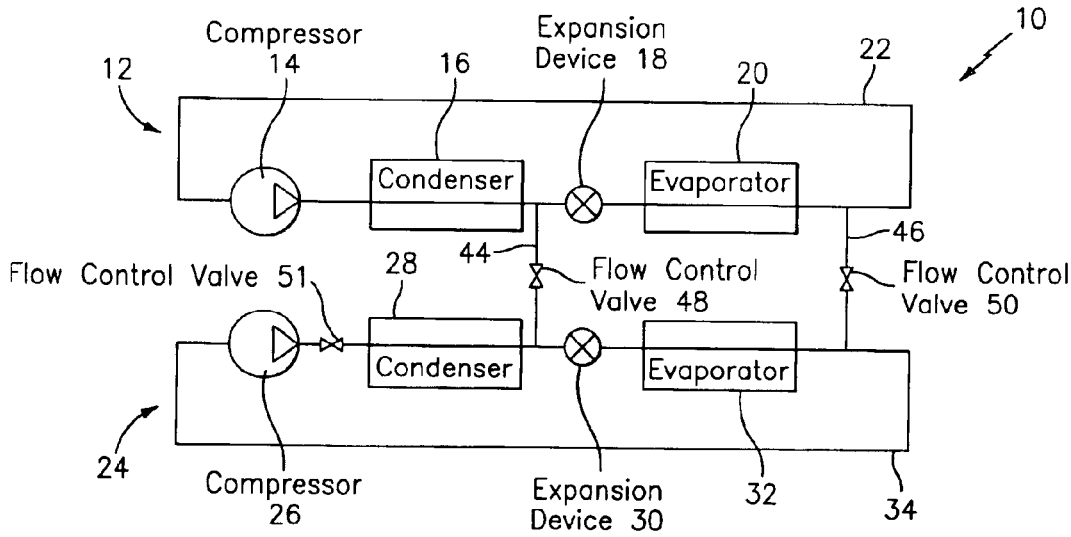
FIG. 3 illustrates a vapor compression system in accordance with the present invention wherein the evaporator of circuit 2 can be selectively incorporated into circuit 1.

Turning now to FIG. 3, a further embodiment in accordance with the present invention is illustrated, wherein first circuit 12 and second circuit 24 have similar components to those described in connection with FIGS. 1 and 2 above. In this embodiment, however, interconnecting flow lines 44, 46 are positioned upstream and downstream of evaporators 20, 32, such that an evaporator of one circuit can be selectively communicated into the other circuit. As in the embodiment of FIG. 2, interconnecting flow lines 44, 46 also advantageously are provided having valves, preferably flow control valves 48, 50 such that flow through the evaporator of the circuit whose compressor is to be shut down can be selectively established as desired, and preferably can be adjusted as well.

Figure 4:
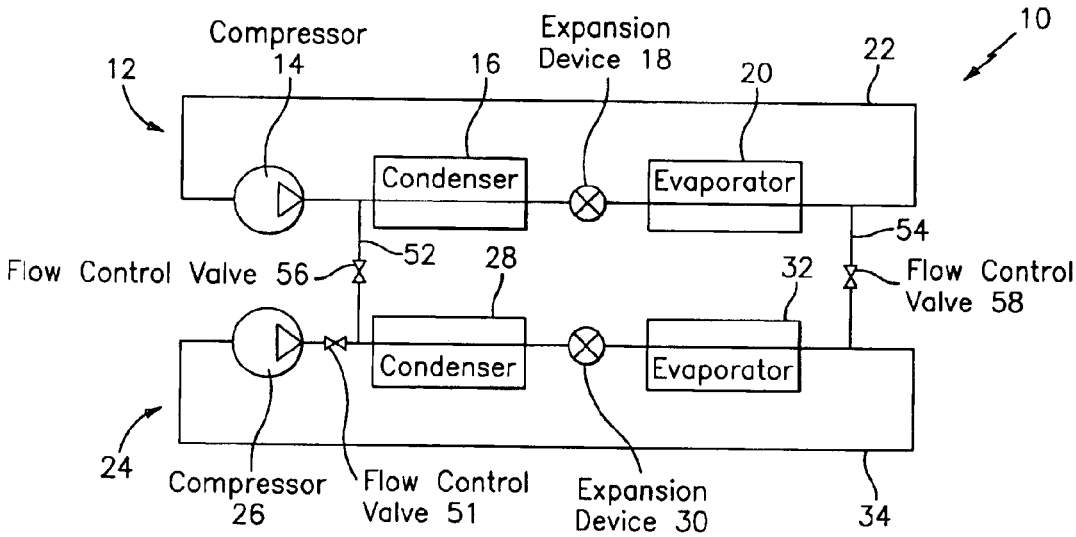
FIG. 4 illustrates a vapor compression system in accordance with the present invention wherein both the condenser and evaporator from circuit 2 can be selectively incorporated into circuit 1.

Turning now to FIG. 4, still another embodiment of the present invention is illustrated wherein first circuit 12 and second circuit 24 have similar components to those described in the embodiment described above. In this embodiment, however, interconnecting flow lines 52, 54 are positioned upstream and downstream, respectively, of both condensers 16, 28 and evaporators 20, 32. In this embodiment, interconnecting flow lines 52, 54 are likewise preferably provided having flow control valves 56, 58. In this embodiment, when a compressor of the multi-circuit system is to be shut down, flow control valves 56, 58 can advantageously be controlled so as to communicate both condenser and evaporator of the shut down circuit into the other circuit.

Figure 5:
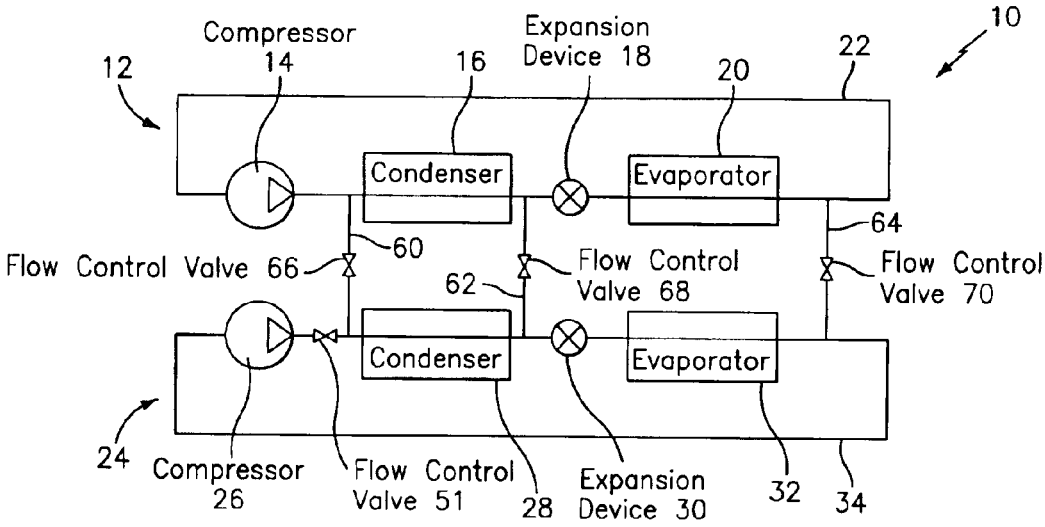
FIG. 5 illustrates a still further embodiment of the present invention wherein the condenser and evaporator, or both, can be selectively incorporated from circuit 2 into circuit 1.

Turning now to FIG. 5, yet another embodiment in accordance with the present invention is illustrated wherein first circuit 12 and second circuit 24 are again provided having similar components to those described above. In this embodiment, however, three interconnecting flow lines 60, 62, 64 are provided, and advantageously positioned as shown, so that either or both of the condenser and evaporator of a circuit to be shut down can be incorporated into operation of the other circuit. Thus, interconnecting flow line 60 is advantageously positioned upstream of condensers 16, 28, while interconnecting flow line 62 is advantageously positioned downstream of condensers 16, 28 and upstream of evaporators 20, 32, and interconnecting flow line 64 is provided downstream of evaporators 20, 32.

Still further in accordance with this embodiment, interconnecting flow lines 60, 62, 64 are further advantageously provided having flow control valves 66, 68, 70, which are advantageously opened and/or closed in combinations to provide for selective communication with the desired condenser and/or evaporator of the other circuit.

It should be appreciated that the system and method of the present invention provide for increased performance in terms of efficiency and capacity of a vapor compression system during part-load operation, when one or the other compressor can voluntarily be shut down, providing for enhanced unloading capability and reliability of the system, or when one compressor is shut down for maintenance or repair. The present invention can be incorporated into existing and/or new systems which have multiple compressors operating on independent circuits, and advantageously allows for use of components such as the evaporator and condenser in a circuit whose compressor is shut down. By re-routing part of the refrigerant flow from the still operational circuit into the condenser and/or evaporator of the shut down circuit, the condensers and/or evaporators in the engaged circuits are unloaded, and overall efficiency and capacity of the system is improved. Additionally, this approach allows a precise match of a building load, thereby reducing a number of start-stop cycles, thus improving reliability.

It should also be appreciated that although the embodiments of the present invention illustrated in FIGS. 2–5 show valve 51 positioned at a discharge end of compressor 26, additional valves can be added into the suction line of the appropriate compressor or compressors as well, and such additional valves can improve system reliability by preventing potential oil migration from running into the shut down compressor, and also by eliminating high-to-low side refrigerant leak.

It should also be appreciated that if a compressor has to be taken completely out of the refrigerant circuit for repair, it must be valved off in the original configuration. Further, additional valves can be placed in the system to prevent refrigerant charge migration, etc.

The valves or flow control valves incorporated into the interconnecting flow lines of the various embodiments of FIGS. 2–5 can be any of a wide variety of valves. Preferably, such valves can be provided as regulating flow control valves which allow for a specified portion of the refrigerant flow to be passed to the other circuit. With this modification, an additional degree of control is advantageously provided to continuously adjust system performance in accordance to external requirements during operation.

Still further, in accordance with the present invention, the expansion devices illustrated in the first and second circuits of the system of the present invention can be electronically controllable expansion valves (EXV) as indicated in FIG. 1, and such structures can eliminate the need for some or all of the valves in the interconnecting flow lines, or compressor suction and discharge valves, in accordance with the present invention.

It should be readily appreciated that in accordance with the present invention, selective communication of one or more components from one circuit into another circuit of a multi-circuit vapor compression system is provided, and this selective communication advantageously allows for enhanced performance, reliability and unloading of compressor system components.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vapor compression system, comprising:

a first circuit comprising first components including a first compressor, a first condenser and a first evaporator;

a second circuit comprising second components including a second compressor, a second condenser and a second evaporator; and means for selectively communicating said first compressor with at least one component of said second components, wherein said means for selectively communicating comprises at least two interconnecting flow lines from said first circuit to said second circuit upstream and downstream of said at least one component.

2. The system of claim 1, further comprising valves positioned along said interconnecting flow lines for selectively allowing flow between said first circuit and said second circuit.

3. A. The system of claim 2, wherein said valves are flow control valves whereby an amount of flow from said first circuit to said second circuit can be selectively controlled.

4. The system of claim 1, wherein said interconnecting flow lines are positioned upstream and downstream of said second condenser.

5. The system of claim 1, wherein said interconnecting flow lines are positioned upstream and downstream of said second evaporator.

6. The system of claim 1, wherein said interconnecting flow lines are positioned upstream and downstream of both said second condenser and said second evaporator.

7. The system of claim 1, wherein said interconnecting flow lines comprise three interconnecting flow lines communicating upstream of said second condenser, downstream of said second condenser and upstream of said second evaporator, and downstream of said second evaporator respectively, whereby said second condenser and said second evaporator can be selectively communicated with said first circuit.

8. The system of claim 7, further comprising valves positioned along said three interconnecting flow lines for selectively allowing flow between said first circuit and said second circuit.

9. The system of claim 8, wherein said valves are flow control valves whereby an amount of flow from said first circuit to said second circuit can be selectively controlled.

10. The system of claim 1, further comprising valves positioned in said second circuit between said second compressor an said interconnecting flow lines whereby said second compressor can be selectively isolated from flow from said first circuit.

11. The system of claim 1, further comprising at least one additional circuit comprising additional components including an additional compressor, an additional condenser and an additional evaporator, and wherein said means for selectively communicating comprises means for selectively communicating said first compressor with at least one component of said second components and said additional components.

12. A method for operating a vapor compression system including at least a first circuit comprising first components including a first compressor, a first condenser and a first evaporator and a second circuit comprising second components including a second compressor, a second condenser and a second evaporator, comprising selectively communicating said first compressor with at least one component of said second components whereby said at least one component can be utilized while said second compressor is shut down.

13. The method of claim 12, wherein said step of selectively communicating comprises providing at least two interconnecting flow lines between said first circuit and said second circuit upstream and downstream of said at least one component.

14. The method of claim 13, wherein valves are positioned along said interconnecting flow lines, and wherein said valves are flow control valves, and wherein said step of selectively communicating comprises selectively controlling an amount of flow from said first circuit to said second circuit with said flow control valves.

15. The method of claim 12, wherein said at least one component is said second condenser.

16. The method of claim 12, wherein said at least one component is said second evaporator.

17. The method of claim 12, wherein said at least one component comprises both said second condenser and said second evaporator.

18. The method of claim 12, wherein said step of selectively communicating comprises providing three interconnecting flow lines communicating upstream of said second condenser, downstream of said second condenser and upstream of said second evaporator, and downstream of said second evaporator respectively; and selectively opening flow through said three interconnecting flow lines whereby said second condenser and said second evaporator can be selectively communicated with said first circuit.

19. The method of claim 12, wherein said vapor compression system further includes at least one additional circuit comprising additional components including an additional compressor, an additional condenser and an additional evaporator, and wherein said selectively communicating step comprises selectively communicating said first compressor with at least one component of said second components and said additional components.

* * * * *